United States Patent [19]

Lieb, Jr.

[11] 4,109,985

[45] Aug. 29, 1978

[54] PROTECTIVE CABINET

[76] Inventor: A. Calvin Lieb, Jr., 25 W. 9th St., Shoemakersville, Pa. 19555

[21] Appl. No.: 776,030

[22] Filed: Mar. 9, 1977

[51] Int. Cl.[2] ..... A47B 43/00

[52] U.S. Cl. ..... 312/262; 46/146; 169/51; 220/6; 248/311.1 R; 312/289; 229/16 R; 340/568; 340/321

[58] Field of Search ..... 248/311.1; 312/258, 312/262, 289; 46/146; 220/6, 7; 169/51

[56] References Cited

U.S. PATENT DOCUMENTS

| | | | |
|---|---|---|---|
| 1,306,136 | 6/1919 | Carpenter | 220/6 |
| 1,972,483 | 9/1934 | Martson | 220/6 |
| 2,456,419 | 12/1948 | Jackson et al. | 220/7 |
| 2,535,256 | 12/1950 | Bewson et al. | 220/7 |
| 3,814,220 | 6/1974 | Brody | 220/6 |

FOREIGN PATENT DOCUMENTS

| | | | |
|---|---|---|---|
| 1,078,484 | 8/1967 | United Kingdom | 220/6 |

*Primary Examiner*—Paul R. Gilliam
*Assistant Examiner*—Alex Grosz
*Attorney, Agent, or Firm*—Richard O. Church

[57] ABSTRACT

A ready access cabinet is disclosed that is comprised of a plurality of panel sections arranged in hinged and spring-tensioned relationship to each other so that when a locking pin is removed, the front, top, bottom and side panels are "exploded" from their engaged closure position into a fully opened one so that immediate and unencumbered access to the contents of the cabinet is provided.

15 Claims, 3 Drawing Figures

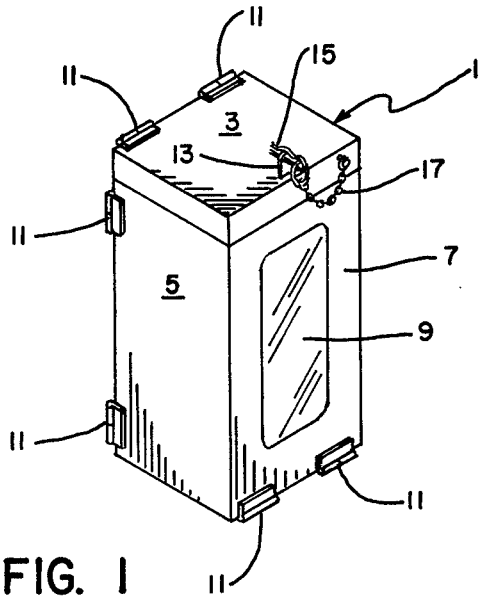
FIG. 1
FIG. 3
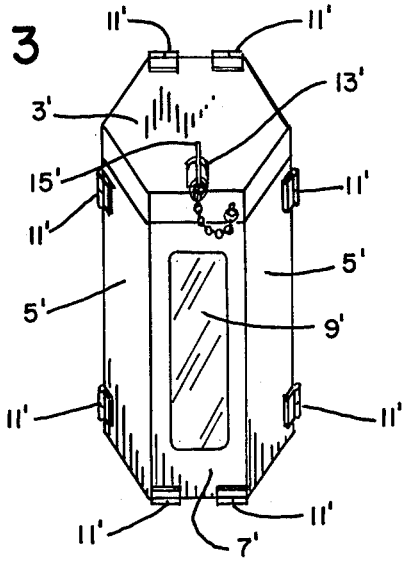
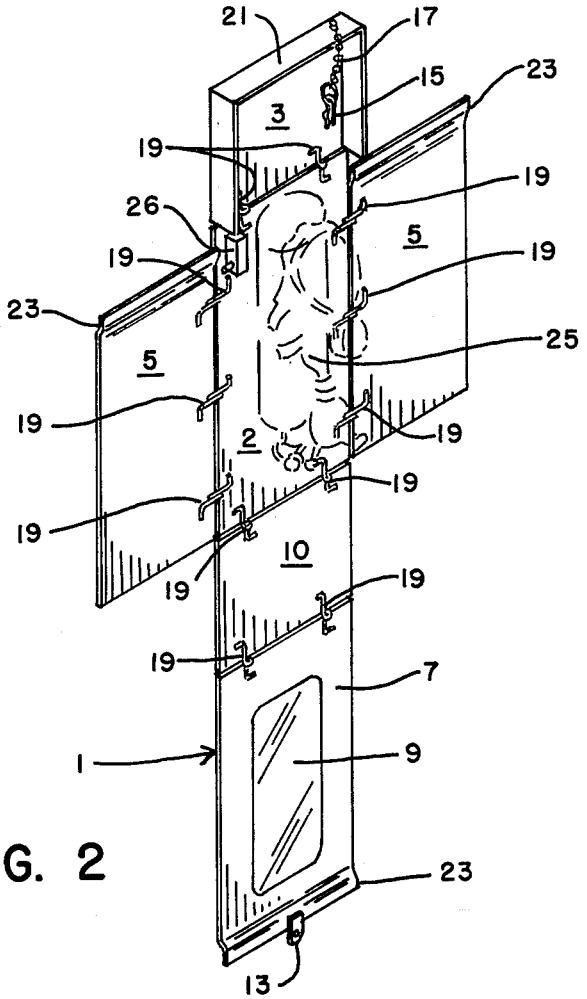
FIG. 2

PROTECTIVE CABINET

BACKGROUND OF THE INVENTION

This invention relates to ready access cabinets and, more particularly, to a protective cabinet that is useful in storing emergency gear, such as breathing apparatus, that may be readily opened to provide immediate access to the emergency device.

It is common practice to store emergency gear in tamperproof containers to prevent theft or accidental damage which would make the apparatus either unavailable or nonfunctional when needed. Such devices include fire-fighting apparatus such as fire extinguishers, hoses, axes, emergency breathing apparatus, fire blankets and the like. The cabinets in which this gear is stored generally have some sort of frangible lock to protect the contents from vandalism and indicate when the door of the cabinet has been opened. These locks may be in the form of an easily broken seal or a small glass plate that is broken to obtain access to the door handle. Frequently, these cabinets are recessed into the wall of a building.

Protective cabinets of the type with which this invention is concerned may prove difficult to open in emergency situations when people are acting under extreme stress, and further, unless the cabinets are suitably dimensioned, it may be difficult to remove emergency gear in a minimum amount of time.

Of special criticality are air-breathing packs and similar devices that are adapted to be carried on the back of an emergency worker. Since these depend on the worker's inserting his arms through a shoulder harness, it may be difficult and wasteful of precious seconds to adjust the shoulder harness, and frequently it requires a coworker to help adjust the backpack. To avoid this particular problem, a number of mounting devices have been suggested in the prior art (see, for example, U.S. Pat. Nos. 3,204,755; 3,490,727; and 3,547,391) that utilize mounting brackets that permit the emergency worker to back up to the supported device, slip his arms through the shoulder harness, and then release the device from its bracket by walking away from it. However, to fully utilize these devices, the mounting brackets should be fully accessible and not stored within the recess of a cabinet.

Thus, conventional cabinets housing emergency equipment suffer from the difficulty that they may be hard to open under times of stress and in that even when open, the emergency gear is recessed into the cabinet, making access to the gear, and particularly fastening it to the body, as with a harness, difficult.

SUMMARY OF THE INVENTION

Accordingly, it is an object of this invention to provide a cabinet that may readily be opened by anyone without reading instructions, without having to break glass protective plates, and under conditions of severe stress when it may be difficult to think properly.

Another object of this invention is to provide a protective cabinet for various apparatus that, when the locking mechanism is removed, opens immediately and fully to provide unencumbered access to the contained gear.

Another object of this invention is to provide a protective cabinet for emergency apparatus that will sound an alarm and indicate the location of the cabinet when the cabinet is opened to obtain access to the emergency apparatus.

A more specific object of this invention is to provide a protective cabinet for emergency apparatus adapted to be carried on the back of an emergency worker, which cabinet, when actuated by activating the locking means, opens fully, not only at its front, but also at its top, bottom and sides to permit an emergency worker to back up to the exposed device, position it on his back and adjust the shoulder harness with facility.

These and other objects of this invention are achieved by forming a cabinet having a plurality of hinged panels that may be rotated with respect to a central base plate. The panels are spring-loaded so that when a locking pin or other locking means is actuated, the top, bottom, front and side panels all "explode" outwardly from each other and move substantially into the plane of the back supporting panel.

DESCRIPTION OF THE DRAWINGS

The objects of this invention may be understood more fully in connection with the following description of the invention in which:

FIG. 1 is a perspective view of a ready access cabinet of this invention in the secured position;

FIG. 2 is a perspective view of the ready access cabinet of this invention in the opened position; and FIG. 3 is a perspective view of a modified form of the cabinet of this invention in the closed position.

In FIGS. 1 and 2 there is illustrated a ready access cabinet 1 made in accordance with this invention. As here illustrated, the cabinet 1 is a hexahedron having rectangular-shaped panels. These include a base panel 2, a top panel 3, side panels 5—5, a front closure panel 7 with an inspection window 9, and a bottom panel 10. The top panel 3, the side panels 5—5 and the bottom panel 10 are attached to and supported by base plate 2 by means of hinges or spring-loaded hinges 11—11. The front or closure panel 7 is attached by means of hinges or spring-loaded hinges 11—11 to bottom panel 10. Staple 13 is provided at the free end of front panel 7 and is adapted to pass through a slit in top panel 13 to permit the insertion of a locking pin 15 which is secured to top panel 3 by means of a chain 17. The top panel 3, side panels 5—5 and bottom panel 10 are provided with springs or spring-loaded hinges 19—19 that interconnect with base panel 2 and are biased to move these panels away from each other into an open position in which the panels will lie substantially in a common plane with base panel 2. Springs or spring-loaded hinges 19—19 are also provided between bottom panel 10 and front panel 9 and are similarly biased to urge the front panel into a substantially common plane with base panel 2.

As illustrated in the drawings, top panel 3 is provided with a downturned flange which is adapted to engage the recessed edges 23—23 of side panel 5—5. The purpose of this arrangement is to secure side panels 5—5 from outward movement when the cabinet is in the closed position; however, this locking mechanism is only by way of illustration as obvious variations will occur to those of ordinary skill in the art.

As illustrated by the phantom lines in FIG. 2, an emergency breathing device 25 is mounted by means of brackets (not shown) on base panel 2.

In operation, an emergency device 25, or other object which it is desired to store in a protective cabinet, is mounted against the base panel 2 by means of suitable brackets (not shown). The various panels are then folded together against the force of the springs into engaging relationship with each other to form a closed housing. When this is done, the downturned flange 21 engages the recessed edges 23—23 of side panels 5—5 and prevents them from moving. Finally, locking pin 15 is inserted through staple 13 securing the cabinet in a fully closed and locked position.

When access to the cabinet is desired, it is only necessary to pull locking pin 15 out of the staple 13, and, due to the force of the springs, the closure will immediately "explode" into a fully opened position where all of the panels lie substantially within the plane of the base panel and completely free access to the contents of the cabinet is gained. This is particularly desirable with emergency gear, such as breathing apparatus, that is adapted to be carried on the back of the worker since the worker can place his back against the breathing apparatus and insert his arms into a shoulder harness without the encumbrance of upstanding top, bottom and side panels.

An alarm device 26 may be associated with the ready access cabinet that will respond any time the ready access cabinet is opened. This may be advantageous to provide for the security of the contents, and also to sound an alarm in case of an emergency and to identify the location of the emergency.

When the ready access cabinet is mounted in the upright position, gravity forces will tend to move bottom panel 10 and front panel 9 into the opened position; therefore, the springs 19—19 connecting the bottom panel 10 with the base panel 2 or the springs 19—19 connecting between bottom panel 10 and front panel 9 may be omitted.

The device of this invention need not necessarily be a symmetrical hexahedron as illustrated in FIGS. 1 and 2, nor need the panel members necessarily be completely planar as the number of sides and the shape of the panels can be adapted to conform to the shape of the device stored within the cabinet. For example, side panels 5—5 could be curved outwardly to accomodate a round article within the cabinet. It should be noted, however, that such curvatures should not be so excessive that the side panels 5—5 are prevented from moving substantially into the plane of the base panel 2 and thus hinder access to the cabinet in its opened position.

As an example of a cabinet that is not a hexahedron, there is illustrated in FIG. 3 a ready access cabinet made in accordance with this invention that is an octahedron. Essentially, in this modification the top 3' and bottom panel (not shown) are hexagonal and there are four side panels 5'—5', two being on one side of the closure panel 7' and two being on the other side. The first of these side panels on one side of the front panel is hinged and spring-biased to the base plate and the second of these side panels is hinged and spring-biased to the first of the side panels.

It can be understood that other geometric forms will find utility in the practice of this invention, depending on the shape of the gear to be stored within the cabinet.

I claim:

1. A protective enclosure adapted to provide immediate and unencumbered access to its contents defined by a plurality of cooperative panels that are configured to seat in mating relationship with each other, comprising:

a base panel having a plurality of rectilinear edges, each edge of which hingedly secures a dependent panel for rotation about an axis defined by the edge of the base panel to which the dependent panel is attached;

one of the dependent panels having a rectilinear edge parallel to and spaced from the edge of the base panel from which it depends;

a closure panel hingedly secured to and mounted for rotation about the axis defined by the rectilinear edge of the one of the dependent panels;

spring means mounted between the base panel and the dependent panels and between the one of the dependent panels and the closure panel biased to urge the hinged panels away from each other and into the plane of the base panel; and releasable locking means which, when engaged, secures the panels in mating relationship with each other against the bias of the spring means.

2. An enclosure according to claim 1 wherein the base panel is rectangular.

3. An enclosure according to claim 2 wherein the dependent panels hingedly secured to the base panel comprise a top panel, two side panels, and a bottom panel.

4. An enclosure according to claim 3 wherein the closure panel is hingedly secured to the bottom panel.

5. An enclosure according to claim 1 wherein the closure panel includes a transparent portion for viewing the contents of the enclosure.

6. An enclosure according to claim 4 wherein all of the panels are rectangular.

7. An enclosure according to claim 3 wherein the side members are curved outwardly.

8. An enclosure according to claim 3 wherein each of the side members is comprised of more than one panel hingedly secured to each other and spring-biased to move the more than one panels into a coplanar position.

9. An enclosure according to claim 1 wherein the contents of the enclosure is emergency equipment.

10. An enclosure according to claim 9 wherein the emergency equipment is adapted to be strapped on the back of an emergency worker.

11. An enclosure according to claim 10 wherein the emergency apparatus is releasably held by the base panel and, after it has been secured to the back of an emergency worker, it may be released from the base panel.

12. An enclosure according to claim 4 wherein the top panel carries a downturned flange on its three sides that are remote from the base panel to secure the side and front panels in the closed position.

13. An enclosure according to claim 1 wherein the releasable locking means includes a staple mounted on the front panel adapted to pass through an opening in the top panel when the enclosure is in the closed position in combination with a pin which is slidably inserted between the staple and the top panel.

14. An enclosure according to claim 13 wherein an alarm is actuated when the releasing locking means is released.

15. An enclosure according to claim 14 wherein the alarm will indicate the location of the enclosure when the locking means is released.

* * * * *